United States Patent [19]

Kotler

[11] Patent Number: 4,860,510

[45] Date of Patent: Aug. 29, 1989

[54] MODULAR PROTECTIVE SURFACING MEMBER

[75] Inventor: Daniel Kotler, Sandy, Utah

[73] Assignee: Duragrid, Inc., Salt Lake City, Utah

[21] Appl. No.: 167,708

[22] Filed: Mar. 14, 1988

[51] Int. Cl.[4] ..... E04F 10/00

[52] U.S. Cl. ..... 52/177; 52/667; 272/3; 4/581; 428/314.4

[58] Field of Search ..... 272/3; 52/177, 667; 4/581, 661; 428/314.4; 15/215

[56] References Cited

U.S. PATENT DOCUMENTS

| | | | |
|---|---|---|---|
| 1,501,739 | 7/1924 | Benedek | 4/581 |
| 2,503,174 | 4/1950 | Salvadore | 4/581 |
| 3,795,180 | 3/1974 | Larsen | 272/3 |
| 3,911,190 | 10/1975 | Myers et al. | 428/314.4 |
| 3,922,409 | 11/1975 | Stark | 272/3 |
| 4,109,439 | 8/1978 | Feasel | 52/667 |
| 4,167,599 | 9/1979 | Nissinen | 52/177 |
| 4,512,044 | 4/1985 | Clark | 4/581 |
| 4,727,697 | 3/1988 | Vaux | 52/177 |

*Primary Examiner*—James L. Ridgill, Jr.
*Attorney, Agent, or Firm*—Thorpe, North & Western

[57] ABSTRACT

A modular tile for interlocking with other similar tiles to form a surface covering which provides a cushioned surface suitable for use in an outdoor playground environment which allows water to substantially flow thereunder for purposes of draining free from the tile. The tile includes a flat support grid having a top and bottom surface and including a repeating pattern of inersection cross members which are integrally formed with interstitial openings therebetween. A plurality of support legs are attached at the bottom surface of the support gird to raise the grid above the supporting surface of concrete or other material. Means are provided around the perimeter of the support grid to allow attachment of additional grids in an interlocking manner. A cushion plate having top and bottom surfaces is adhered to the top of the support grid to form an integral tile which cooperatively provides impact protection for playing children, as well as increased comfort, yet which enables flow of water and protection of tile structure against mildew and other water damage.

9 Claims, 2 Drawing Sheets

MODULAR PROTECTIVE SURFACING MEMBER

BACKGROUND OF THE INVENTION

1. Field of Invention

The present invention relates to a modular flooring member which can be interlinked with other similar flooring members to develop a continuous flooring surface for use on playgrounds, gym floors and other rigid surfaces. More particularly, the present invention relates to a dual component floor covering member which provides a rigid, raised cushioned support for use above rigid floor and playing surfaces, and particularly above moisture-bearing surfaces.

2. Prior Art

Playground areas for children are often the scene of accident and injury, particularly where playground equipment is elevated above a hard surface such as asphalt or cement. Many children have been paralyzed by falls from a swing, monkey bars, or the like, because of head injuries upon impact with the ground. Unfortunately, children are not aware of such risks and continue to take chances because of their limited experience.

Where play equipment is within an indoor area, cushion pads are commonly laid on the floor surface to protect against such injury. Unfortunately, it is impractical to simply lay pads on outdoor surfacing materials because of moisture and adverse wear and tear associated with outdoor play. Furthermore, cushion padding captures moisture at its pavement-contacting surface, which provides an environment for bacteria growth and results in decay of many padding materials. Because of the high cost of such padding, and its inability to weather outdoor environments, few schools and communities invest in this form of safety equipment. Nevertheless, lawsuits arising from injuries frequently exact payment for failure to cushion high risk areas.

Many forms of modular flooring have been developed for other applications such as playing courts, work zones, shower flooring, etc. Typically, such modular flooring is of plastic, injection-molded construction with interstitial openings with a cross grid of supporting members. The interstitial opening permits debris, water or other material to fall through, leaving the contacting surface clear. Such flooring structure is particularly useful where water accumulates because the water may pass underneath the modular structure without affecting the top, foot-contacting surface. Therefore, whereas the support floor formed of concrete, brick or other sturdy construction remains moist, soiled or otherwise affected, the foot-contacting surface remains fully useful.

U.S. Pat. No. 4,109,439 illustrates a grid structure used as flooring mat which illustrates the interstitial openings and cross support members. U.S. Pat. No. 4,167,599 illustrates another embodiment of such a flooring member constructed of plastic and useful in the various environments set forth above. Although these references disclose modular grid members which are useful generally as a flooring surface, they do not relate specifically to cushioned applications on an high risk outdoor playground within a water-affected environment. In fact, some forms of flooring grid might increase the risk of laceration upon impact because of the exposed rib construction.

Other cushioned surfacing materials have been developed with specific application for wet surroundings.

For example, in a shower stall or swimming pool area, walking on the grid structure of the previously cited patents would cause great discomfort to the exposed skin of the foot. Accordingly, U.S. Pat. No. 3,605,166 shows a grid structure which is disposed on top of a mat in such a manner that the mat catches water flowing through openings of the grid. This design, however, is not a modular concept, nor does it relate to the primary environment of application for the present invention, specifically, placement of the mat on a cement surface subject to moisture would result in mildew and other adverse rotting effects on the mat structure at its underside.

A more recent patent, U.S. Pat. No. 4,512,044 discloses an attempt to provide a comfortable walking surface while enabling water or fluid to flow therebelow and between the supporting surface and underside of the modular flooring member. This structure includes a series of cross-channels forming a gridwork of fluid pads which permit the water to flow underneath the modular flooring to some degree. Nevertheless, a majority of the subsurface of the flooring member is in direct contact with the moist support floor and would be subject to the same problems of mildew and degradation arising from captured water.

Another prior art disclosure is set forth in U.S. Pat. No. 1,501,739 by Benedek. This product is a bath mat made of multiple components including a top, perforated cover, a subsupport structure to maintain the cover above an open cavity. The base portion of this open cavity comprises a graded flow plate which conducts water through a flow channel disposed centrally within the cavity. Such structure is clearly not suitable for modular concept because the flow channel has a single direction of water delivery and would therefore be unacceptable where water flow travels in more than one direction. For example, the Benedek structure would only be useful in a linear array, and would require substantial adaption far beyond the intent of its disclosure.

A final item of cited prior art is U.S. Pat. No. 2,503,174 by Salvador. Again, this item is not a modular design intended for forming a broad flooring surface. It merely is a bathroom mat to be used as a single structure. A base portion is a collection basin where water is retained, rather than passing through to any flooring therebelow. Within this basin is a water-absorbent layer of foam material which is designed to absorb all water from an individual drying off after a shower. Accordingly, it does not suggest the utility of allowing water to flow below a comfortable flooring structure.

None of the cited art provides structure that could be economically applied in an outdoor environment for protection of children against high risk falls. It is also apparent that none of these structures is well suited for modular assembly to form a cushioned, water-compatible surface covering which will remain in place and which can be formed around different types of upright poles, walls and other forms of playground support structure. More importantly, none of these prior art structures is adapted to provide a safe, moisture-compatible playing surface for children which is within a reasonable economic price range affordable to a typical community.

OBJECTS AND SUMMARY OF THE INVENTION

It is an object of the present invention to provide a modular tile which provides a unique impact surface at ground level which greatly reduces risk of injury to a falling child but which allows water to substantially flow thereunder for purposes of draining.

It is a further purpose of this invention to provide a cushioned modular tile which forms a single structure with a rigid support base which can be interlocked to form a uniform ground or floor covering.

It is yet another object of this invention to provide a modular tile which can be assembled and disassembled at will to form a variety of different patterns of covering for use in changing applications.

These and other objects are realized in a modular flooring member which includes a flat, resilient support grid having top and bottom surfaces formed in a pattern of intersecting cross members which define interstitial openings through the grid. These cross members are integrally joined at cross junctions to provide a support system for resilient legs attached at the cross junctions in generally perpendicular orientation with respect to the support grid. The perimeter of the support grid is adapted with coupling means which enables the attachment of several grids to form a continuous flooring surface. The grid further comprises a cushion plate having top and bottom surfaces and being dimensioned in size to conform to the dimensions of the support grid. The top surface of the cushion plate is adapted for foot traffic, whereas the bottom surface is provided with means for integral attachment to a top surface of the support grid. The tile therefore provides a single, integral structure that merges the cushion effect of the plate with the resilience of the grid to provide a surprisingly effective impact-absorbing structure which can also resist adverse effects of moisture between the covering tile structure and the ground.

Other objects and features of the present invention will be apparent to those skilled in the art in view of the following detailed description, taken in combination with the drawings.

DETAILED DESCRIPTION OF THE INVENTION

Figure 1:
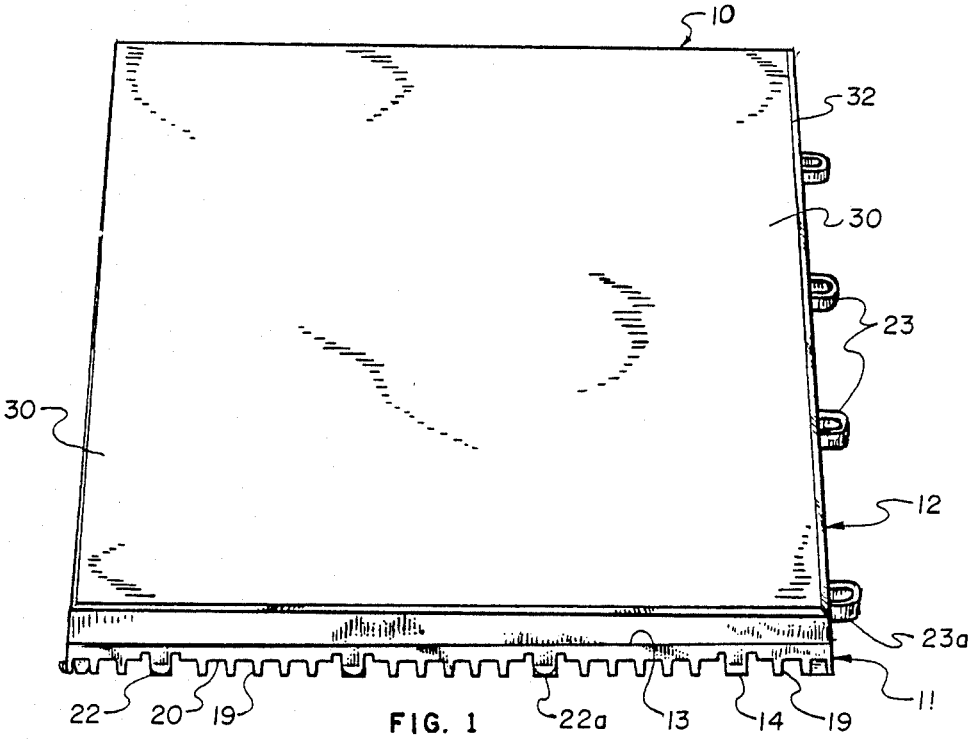
FIG. 1 shows an elevated, frontal perspective view of a modular tile constructed in accordance with the principles of the present invention.

Referring to the figures:

FIG. 1 shows a modular tile of two-part construction designed in accordance with the principles of the present invention. This tile, shown generally as Item 10, comprises a flat, plastic support grid 11 and a cushion plate 12 which is attached at the top of the grid 11. The support grid includes a top 13 and bottom 14 surface structure and is made of a repeating pattern of intersecting cross members (see FIG. 4), which cross members are integrally formed with interstitial openings 16 therebetween. These openings 16 communicate through the grid and allow for ventilation as well as a reduction in material cost.

Figure 4:
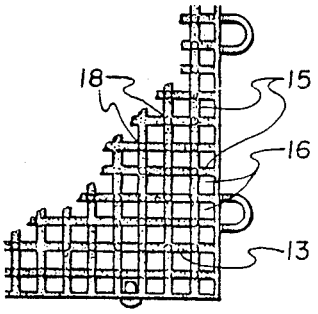
FIG. 4 illustrates a section of the support tile to which the cushion plate is attached.

The cross members 16 intersect at cross junctions 17 as illustrated in FIG. 4. Although such intersections are shown to be orthogonal in relationship, it will be apparent to those skilled in the art that orientations and geometrical configurations will be utilized and provide the required support to the cushion plate 12. The top surface 13 provides a generally flat mounting area for attachment of the cushion plate 12. This will be discussed in greater detail hereafter.

Figure 5:
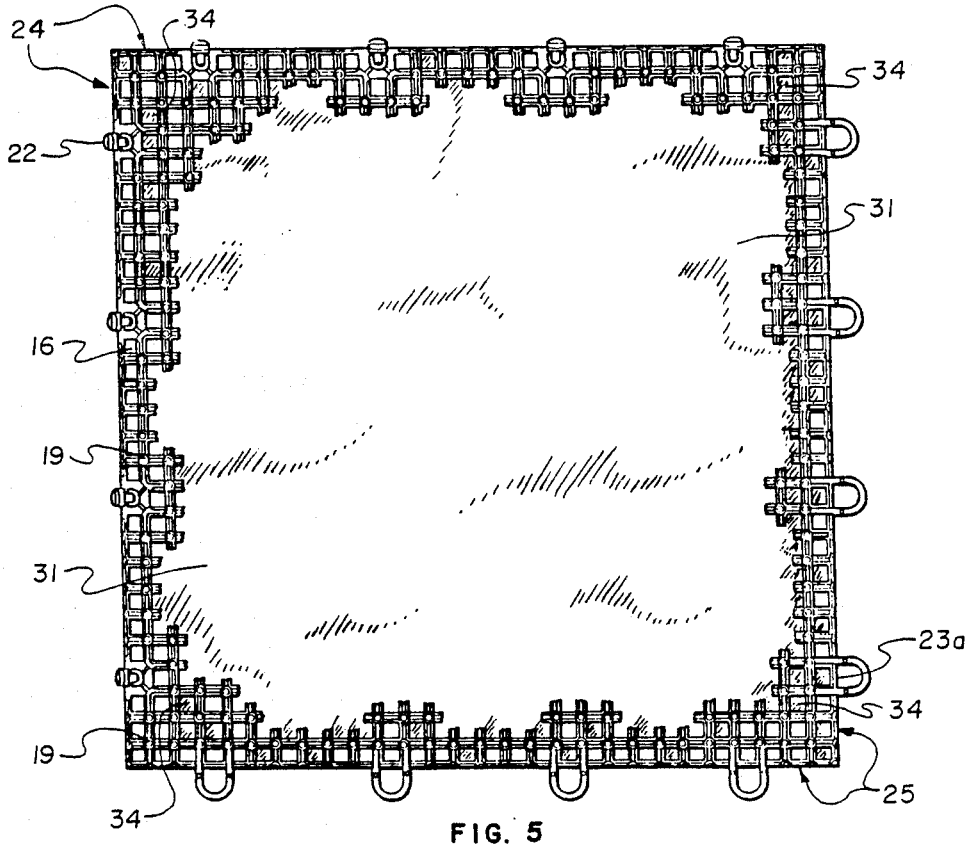
FIG. 5 shows a cutaway view of the subject tile as seen from the bottom of FIG. 1, with the center portion of the rigid tile support being deleted, thereby exposing the cushion member adhered at the top portion.

A plurality of support legs 17 of common length are integrally coupled to a base side 18 of the cross junctions 17. Typically, such support legs will be in perpendicular orientation with respect to the support grid and will be sufficiently close in spacial relation with adjacent legs to provide a uniform and sturdy support across the total area of the attached cushion plate. The specific configuration of leg represented as Item 19 in the figures, is more clearly illustrated in FIGS. 5 and 6. This leg comprises a truncated, conical shape which is attached at its base end to the base side 20 on the support grid. The length of the illustrated support leg is approximately 1 centimeter, which is also the approximate distance of separation between the supporting legs.

The perimeter of the support grid 11 includes a plurality of male 22 and female 23 interlocking members. As is more clearly shown in FIG. 5, one pair of male interlocking members is formed on two adjacent sides 24 of the support grid and two opposing female interlocking members are coupled to adjacent opposing sides 25.

Figure 3:
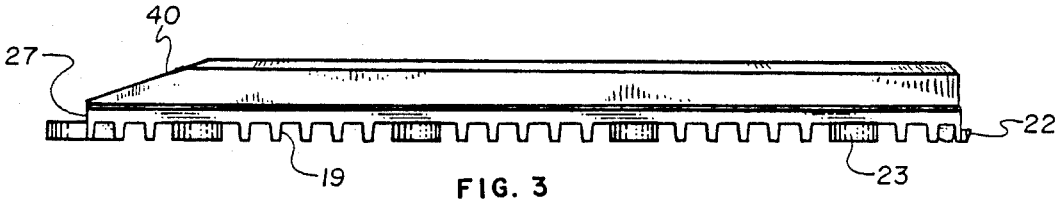
FIG. 3 is a side view of a tile similar to that shown in FIG. 1 as viewed from the back side, but having a modified cushion member with the tapered edge.
Figure 6:
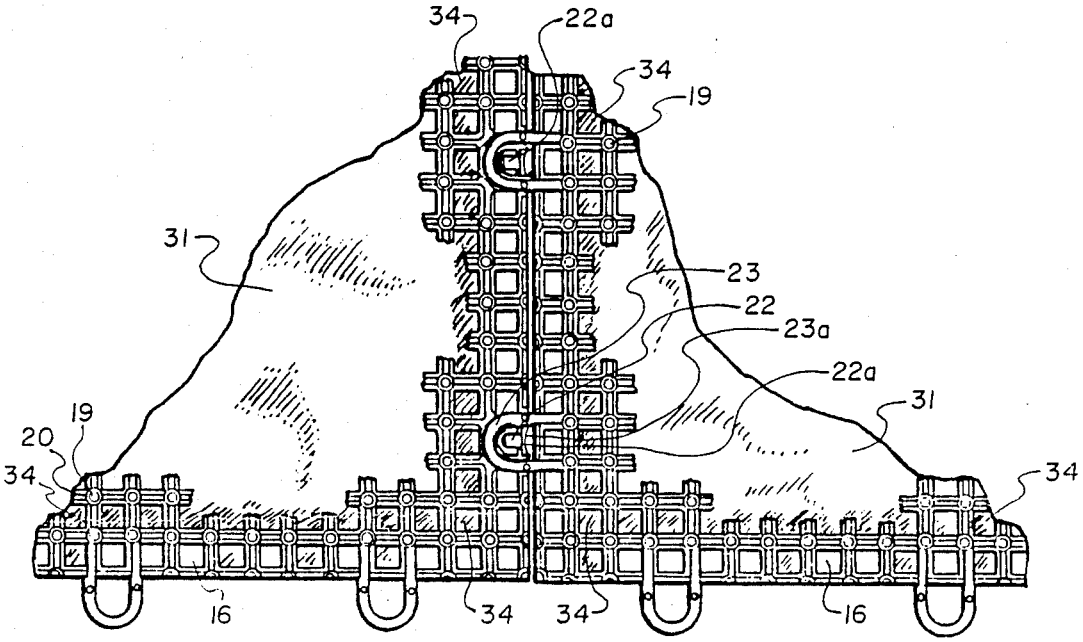
FIG. 6 shows a cutaway view of the corner sections of two adjoining tile units attached in interlocking relationship and viewed from a bottom side thereof.

The male interlocking member 22 comprises a broadened support leg structure with a projecting lip **22*a* (FIGS. 1 and 2) which extends outward and interlocks within the opening of the female member 23 at an interior ridge section 23*a*. This interlocking relationship is illustrated in FIG. 6, wherein the male member 22 has been inserted within the opening of the female member 23, with the lip 22*a* engaging the ridge 23*a*** at the back wall of the female member. This interlocking relationship permits multiple tiles to be closely coupled to form a continuous floor surface of any desired dimension. The structure is also well suited for modification by disassembly and reassembly in a new location with a different configuration. This versatility is particularly good for playground areas where portable equipment may be changed, requiring modifcation of ground layout.

Where the outer perimeter 27 forms an exterior tile member defining an outer edge of the total floor covering, the interlocking members are not included. This provides a uniform wall edge which gives a finished appearance to the flooring. The cushion edge is tapered as shown in FIG. 3, Item 40 to reduce the possibility of tripping at its raised edge.

The support grid may be fabricated of many resilient plastics which also provide sufficient rigidity to maintain a uniform support base under the cushion plate. Such plastics include polyethylene, polypropylene, polycarbonate, polyvinyls and other resilient plastics which are suitable for injection molding. It will be apparent to those skilled in the art, based upon the prior art disclosure and references, that many materials may be applied in addition to plastics for development of a suitable support group.

The second primary element of the subject modular tile comprises the cushion plate 12. This plate has a top 30 and bottom 31 surface which are substantially flat and parallel. The dimensions of the top and bottom surfaces roughly correspond to the main dimensions of the support grid 11. The top surface includes a chamfered edge 32 which extends around the perimeter of the cushion plate. This chamfered edge provides a decorative appearance to the floor and facilitates flow of water from the surface to the underside of the tile. Typically, the top surface is a flat finish which is adapted for foot traffic, and may be either smooth or textured, depending on the application of the tile.

The bottom surface 31 of the tile is adapted for attachment to the top surface 13 of the support grid. This attachment is accomplished by use of an adhesive material, such as epoxy glue 34 which is applied around the perimeter of the tile as illustrated in FIG. 6 by the darkened course of interstitial openings connecting the designated items 34. In this manner, the attached adhesive extends into the interstitial openings to form an interlocking projection which anchors the cushion to the support grid. These projections, extending around the periphery at locations identified in items 34, form a circumscribing array of projections which securely anchor the cushion plate to each respective support grid. Other locations of applied adhesive across the surface 31 of the cushion plate may be applied to ensure total retention across the grid surface.

In the attached configuration, the support grid 11 and cushion plate 12 form an integral tile which provide a rigid base with open channels for water flow in all directions, yet having a comfortable surface providing a cushion effect with resilience to restore the surface to its generally flat configuration. Although many foam materials may be selected, the preferred embodiment for the cushion plate utilizes a closed cell foamed polymer such as Ensolite (TM) manufactured by Uniroyal Plastics Company of Mishawaka, Ind. These compositions should have a density in the range of approximately 2 to 10 pounds per cubic foot. The most preferred range of polymer density is 5.5 to 7 pounds per cubic foot, with a thickness of at least 6 millimeters. The embodiment illustrated in the figures has a thickness of approximately 1.5 centimeters.

The closed cell nature of the polymer permits the material to absorb impact and maintains maximum cushion effect. The closed cell structure also resists absorption of water and thereby enhances resilience of the cushion plate, despite its application in a water environment. It also develops a surprising energy absorption response when integrally coupled to the support grid. The ability of this combination to absorb energy is illustrated by the fact that an uncooked egg can be dropped from a height of greater than five feet and remain unbroken upon impact with the present tile. This unexpected response appears to arise from the interaction of the closed cell foam with the more resilient plastic grid.

For example, the isolated grid support offers exceptional resilience to prevent breakage. If a glass bottle is dropped onto the grid structure it simply bounces, rather than breaks. This occurs even if the grid is positioned on concrete. Without offering analytical proof of a particular mechanism, it is suggested that this resilience property cooperates with the energy absorption of the closed cell foamed polymer, to transfer forces in such a way that the fragile egg shell remains intact, despite its impact at the tile surface. It will be apparent that such a response to an egg shell offers evidence of excellent protection to a falling child who might otherwise receive a severe concussion.

Figure 2:
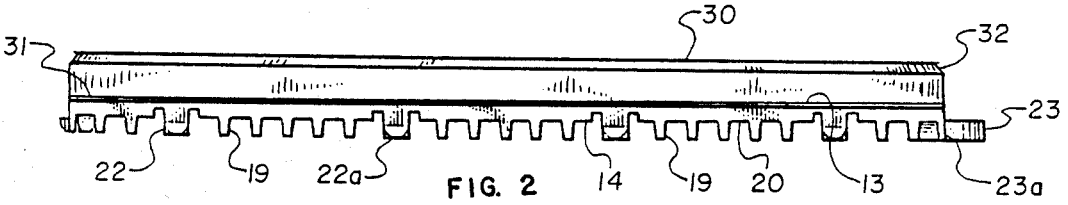
FIG. 2 is a side view of the tile in FIG. 1, taken along the front edge.

FIG. 3 illustrates a variation from the squared edge cushion configuration of FIGS. 1 and 2. In this instance, a deep champfered edge 40 is provided for use around the final perimeter of the flooring area. This deep champfer 40 provides a tapered edge which reduces likelihood that individuals may trip or stub a toe when crossing this perimeter.

It will be apparent to those skilled in the art that the foregoing description is intended to be an example of the preferred embodiment, applying the principles of the invention disclosed. Accordingly, the scope of the invention is not to be limited by the foregoing description, that is defined in the following claims.

I claim:

1. A modular tile for interlocking with other similar tiles to form a floor or ground covering which provides a cushioned impact object but which allows water to substantially flow thereunder for purposes of draining free from the tile, said tile comprising:

a flat plastic support grid having top and bottom surfaces and including a repeating pattern of intersecting cross members integrally formed with interstitial openings therebetween communicating through the grid, said cross members being integrally joined at cross junctions;

a plurality of resilient support legs of common length integrally coupled to a base side of the cross junctions in general perpendicular orientation with respect to the support grid;

means coupled around the perimeter of the support grid for joining the grid at each edge to additional grids in interlocking manner;

a foamed, closed-cell resilient, cushion plate having top and bottom surfaces and width dimensions substantially the same as those of the support grid, said top surface being adapted for foot traffic, said bottom surface being adapted for attachment at the top surface of the support grid; and means for integral attachment of the cushion plate at the top surface of the support grid.

2. A modular tile as defined in claim 1 wherein the closed-cell cushion plate is fabricated from closed cell foam polymer.

3. A modular tile as defined in claim 1, wherein the cushion plate has a side wall which is substantially configured with a vertical, squared side wall of a second cushion plate.

4. A modular tile as defined in claim 1, wherein the cushion plate includes at least one edge having a deep champfer providing a taper which extends substantially from the top surface of the cushion plate to the bottom surface thereof, thereby forming a slanting terminal perimeter edge.

5. A modular tile as defined in claim 1, wherein the cushion plate comprises a foamed polymer having a density in the range of 2 to 10 pounts per cubic foot and a thickness of at least 6 millimeters.

6. A modular tile as defined in claim 1, wherein the cushion plate comprises a foamed polymer having a density in the range of 5.5 to 7 pounds per cubic foot and a thickness of at least 1.0 centimeters.

7. A modular tile as defined in claim 1, wherein the means of attachment comprises adhesive means adhered between the bottom surface of the cushion plate and the top surface of the support grid.

8. A modular tile as defined in claim 7, wherein the adhesive. means comprises epoxy material.

9. A modular tile as defined in claim 8, wherein the adhesive means extends into the interstitial openings to form an interlocking adhesive projection which extends around the cross members and mechanically anchors the cushion to the support grid.

* * * * *